US005857519A

United States Patent [19]

Bowlin et al.

[11] Patent Number: 5,857,519

[45] Date of Patent: Jan. 12, 1999

[54] DOWNHOLE DISPOSAL OF WELL PRODUCED WATER USING PRESSURIZED GAS

[75] Inventors: Kevin R. Bowlin, Sugarland, Tex.; James R. Stoy, Jakarta, Indonesia

[73] Assignee: Texaco Inc, White Plains, N.Y.

[21] Appl. No.: 903,870

[22] Filed: Jul. 31, 1997

[51] Int. Cl.[6] ..... E21B 43/00

[52] U.S. Cl. ..... 166/105.6; 166/106; 166/187

[58] Field of Search ..... 166/105, 106, 166/187, 387, 54, 105.5, 105.6

[56] References Cited

U.S. PATENT DOCUMENTS

| | | | |
|---|---|---|---|
| 1,605,174 | 11/1926 | Craig et al. | 166/105.6 |
| 1,757,267 | 5/1930 | Stanley | 166/105.6 |
| 3,718,407 | 2/1973 | Newbrough | 417/108 |
| 3,873,238 | 3/1975 | Elfarr | 417/54 |
| 3,963,073 | 6/1976 | Laval | 166/105.1 |
| 4,083,660 | 4/1978 | Newbrough | 417/108 |
| 4,251,191 | 2/1981 | Gass et al. | 417/111 |
| 4,347,899 | 9/1982 | Weeter | 166/310 |
| 4,405,291 | 9/1983 | Canalizo | 417/393 |
| 4,551,075 | 11/1985 | Canalizo | 417/383 |
| 4,826,406 | 5/1989 | Wells | 417/120 |
| 4,977,958 | 12/1990 | Miller | 166/51 X |
| 5,217,067 | 6/1993 | Landry et al. | 166/68 |
| 5,296,153 | 3/1994 | Peachey | 210/787 |
| 5,497,832 | 3/1996 | Stuebinger et al. | 166/369 |

FOREIGN PATENT DOCUMENTS

| | | |
|---|---|---|
| 2077366 | 12/1981 | United Kingdom . |
| 2108593 | 5/1983 | United Kingdom . |

*Primary Examiner*—Roger J. Schoeppel
*Attorney, Agent, or Firm*—Henry H. Gibson; Arnold White & Durkee

[57] ABSTRACT

A method and apparatus for the downhole disposal of the water component of production fluid while using gas lift techniques to lift the hydrocarbon component to the surface is disclosed. Separation of the hydrocarbon component and the water component takes place downhole by gravity in an annulus formed between the well casing and a tubing string. The water component may be disposed of or utilized to carry out a water-flood of either overlying or underlying subterranean formations. As a result, the lifting, handling and disposal of the water component of the production fluid on the surface is minimized.

11 Claims, 5 Drawing Sheets

DOWNHOLE DISPOSAL OF WELL PRODUCED WATER USING PRESSURIZED GAS

BACKGROUND OF THE INVENTION

1. Field of the Invention

The present invention is generally directed to a method and apparatus for the downhole disposal or injection of water in a well using natural gas supply. In particular the present invention uses pressurized gas to operate both a downhole pump used for injection and lift the desired petroleum portion and some water of the produced fluid to the surface.

2. Background

Many hydrocarbon and natural gas producing wells generate water from the same subterranean formation that produce the hydrocarbon and gas. In typical practice, the production fluid, a mixture of both hydrocarbon and water, is pumped or "lifted" to the surface. The water is separated from the hydrocarbon at the surface and the water subsequently treated and disposed of on the surface or reinjected back into a suitable disposal formation.

In wells having sufficient underground pressure within the producing formation, the production fluid is lifted "naturally" and the principle operating cost of the well is the disposal of the water in an environmentally conscious manner. However, there are a significant number of wells in which the underground pressure is not sufficient to lift the production fluid to the surface without pumping or some other artificial lifting of the fluid. The artificial lift may be provided by downhole pumps which require either mechanical (e.g. sucker pumps, progressive cavity pumps), electrical (e.g. electric submersible pumps) or hydraulic connections (e.g. hydraulic turbine centrifugal pumps) to the surface. Another technique often used is "gas lifting" in which compressed gas is used to lift the production fluid to the surface. Gas lifting is typically used in situations where the location of the well does not allow for the use of the other pumping techniques due to a lack of space or infrastructure or other factors. Examples of the gas lift technique can be found in several U.S. Patents including U.S. Pat. Nos.: 5,217,067; 4,251,191; 3,718,407; and the references cited therein, the contents of which are incorporated herein by reference.

When the water cut (i.e. percentage of water) of the production fluid is high, the cost of pumping the production fluid to the surface and the disposal of the water makes the well uneconomical to operate. In gas lifting wells, a high water cut makes the well uneconomical or even impossible to operate because of the operating cost, and the cost and space needed for the equipment required to recover the hydrocarbon and dispose of the water. It such cases it may also be desirable to create downhole water floods, conserve supply gas on the surface, reduce the impact of hydrocarbon production on the environment as well as other benefits that will be apparent to one of skill in the art.

Methods for the downhole disposal of the water contained in production fluid have been recently developed to reduce the cost of operating high water cut hydrocarbon wells. One such method is described in U.S. Pat. No. 5,296,153 in which a cyclone separator is placed downhole to separate the hydrocarbon and water components of the production fluid. The hydrocarbon component is lifted to the surface either naturally or by a mechanical, electrical or hydraulic downhole pump. A second downhole pump is used to dispose of the water component in an underlying porous formation. In order to drive the dual downhole pumps some sort of mechanical, electrical or hydraulic connection to the surface is required. Further, in order for the cyclone separator to be effective, the water cut is limited to 80%. In addition to the capital cost and maintenance required for operation, the size of the existing well casing string may prevent the installation of downhole pumps. Thus, if the well is to remain productive, a new hole must be drilled and a larger casing installed.

Another method for the downhole disposal of the water component of the production fluid is disclosed in U.S. Pat. No. 5,497,832. In the described method, the upstroke of a sucker rod pump is used to lift a fluid mixture of primarily hydrocarbon to the surface. The downstroke of the sucker rod pump is used to inject the remaining water component into a disposal formation.

Using present technology, the use of downhole water separation and disposal in a high water cut well requires a connection from the surface—be it mechanical (e.g. sucker rod or rotating rod string), electrical (e.g. cables) or hydraulic (e.g. hydraulic fluid lines), or other conventional methods geared to use existing infrastructure to drive the downhole pump system. As noted above, gas lift wells are often located in places were the cost and space for such support infrastructure is prohibitive. For example, there are many coastal water hydrocarbon platforms were space is very limited and the provision of electrical power is not possible. When the water cut from these gas lift wells becomes too high, they are either capped and abandoned or idled for production at a later date.

SUMMARY OF THE INVENTION

The present invention concerns a method and apparatus for the downhole disposal of the water component of production fluid while using gas lift techniques to lift the hydrocarbon component to the surface. An important aspect of this invention is the use of the annulus between the well casing string and the production tubing string for the natural gravity separation of the hydrocarbon and water components within the wellbore. At least two inlet ports in the tubing string, an upper hydrocarbon inlet port and a lower water inlet port, may be vertically spaced above and below the perforations in the well casing string. This arrangement allows for the passage of a fluid comprising a majority of the hydrocarbon component through the hydrocarbon inlet port and the passage of water through the water inlet port. Another aspect of the invention is the use of at least a portion of the high pressure lift gas to power a downhole pump for the disposal or reinjection of the water component of the production fluid. The exhaust gas from the pump is then used to assist in the lifting of the hydrocarbon component to the surface. The present invention provides for water injection into a disposal formation at a low cost while utilizing the economics of conventional gas lift technology to bring hydrocarbon to the surface. Further benefits include the reduction in water handling at the surface, the elimination of surface infrastructure for powering the downhole water disposal pump and the cost associated with these processes.

BRIEF DESCRIPTION OF THE DRAWINGS

These and other features of the present invention are more fully set forth in the following description of illustrative embodiments of the invention. The description is presented with reference to the accompanying drawings in which.

DESCRIPTION OF ILLUSTRATIVE EMBODIMENTS

Figure 1:
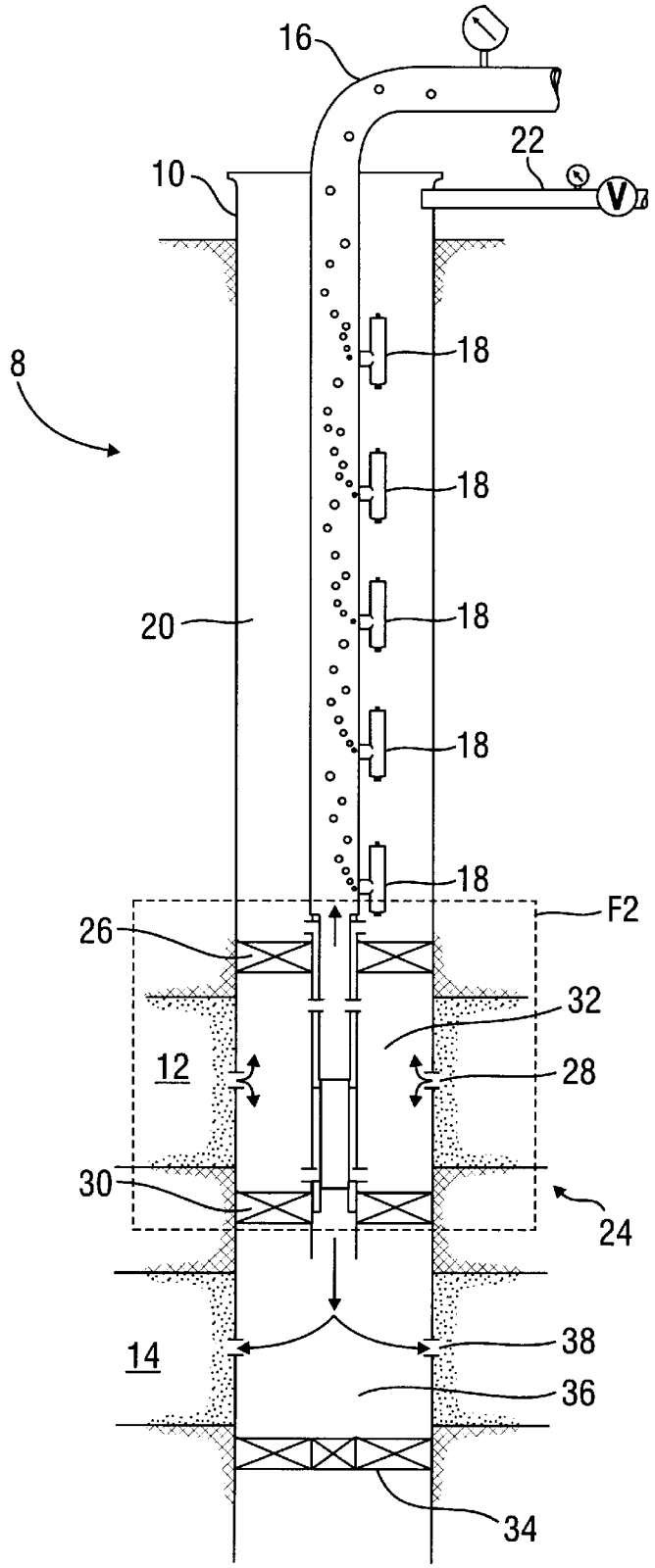
FIG. 1 is cross-sectional view of a gas lift well arrangement illustrating an embodiment of the present invention.

With reference to FIG. 1, an hydrocarbon well (8) is generally shown in which gas lift technology is used to lift the hydrocarbon component of the production fluid to the surface. As in most hydrocarbon wells, a casing string (10) passes through at least one hydrocarbon producing formation (12) and at least one porous disposal formation (14) into which the water component of the production fluid can be injected. This disposal formation (14) may be an hydrocarbon producing formation in which a water flood has been initiated or it may be a salt zone or some other zone in which the water component can be injected without harm to the environment. A tubing string (16) with gas lift valves (18) extends the length of the casing string (10) forming an outer gas annulus (20) between the casing string (10) and the tubing string (16). Means (22) for introducing high pressure gas into the outer gas annulus (20) are provided for on the surface. In this particular embodiment, gas lift valves (18) inject the high pressure gas contained within the outer gas annulus into the tubing string (16) thereby lifting the hydrocarbon component of the production fluid to the surface. A downhole pump, generally indicated by arrow (24), is located within the tubing string (16) at a vertical location corresponding to the producing formation (12) and is used in the downhole disposal of the water component of the production fluid. An upper packer (26) prevents the high pressure gas from penetrating the production zone (12) through the production perforations (28) in the casing string (10). A lower packer (30) is vertically located below the producing perforations (28) so as to form a separation annulus (32) between the casing string and the tubing string. The separation annulus (32) is generally vertically located at the same level at which the downhole pump (24) is positioned. Below the lower packer (30), an injection packer (34) seals the casing string (10) so as to form an injection chamber (36) through which the water to be injected into the disposal formation (14) exits under pressure by way of injection perforations (38). The downhole area bounded by dashed line F2 is shown in FIG. 2 in greater detail and to which the following description is referenced.

Figure 2:
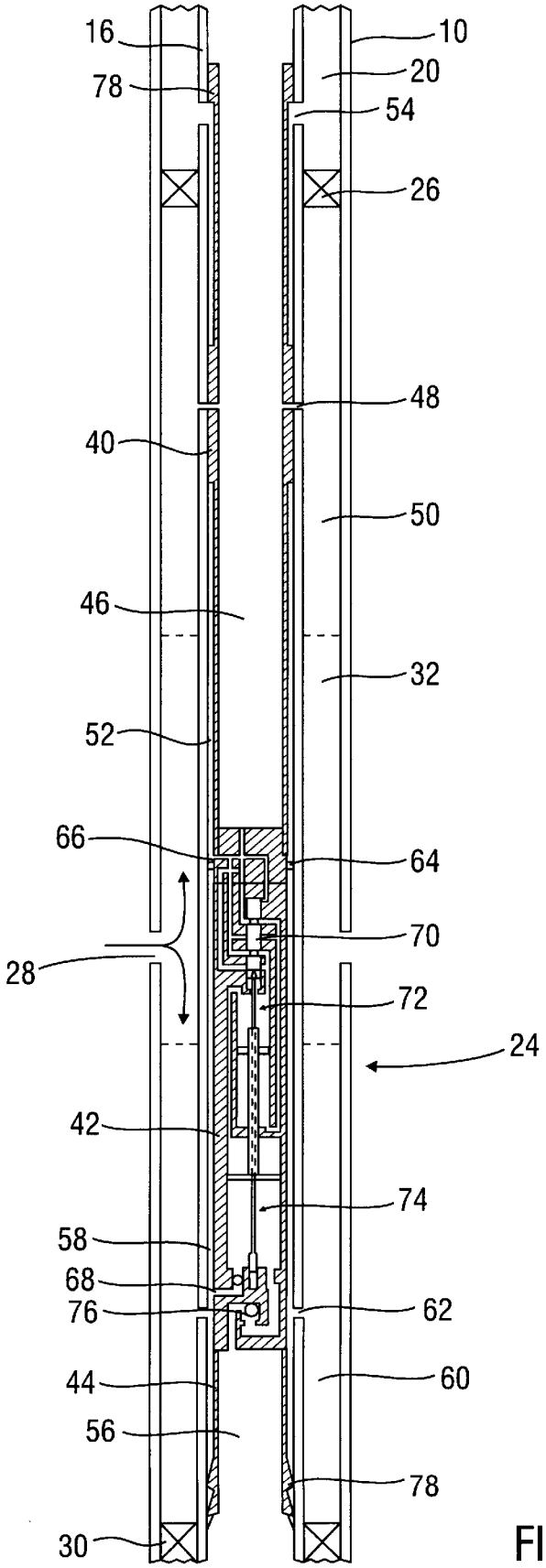
FIG. 2 is a magnified cross-sectional view of the downhole arrangement of the embodiment shown in FIG. 1.

As shown in FIG. 2., the downhole pump, as generally indicated by arrow 24, is contained within the tubing string (16), and includes an upper pump mandrel (40), a pump body (42) and a lower pump mandrel (44). The upper pump mandrel (40) is connected to the tubing string (16), and the top of the pump body (42), thus forming an upper pump mandrel chamber (46) which is in fluid connection with the tubing string (16). At least one hydrocarbon inlet port (48) provides for a fluid connection between the upper pump mandrel chamber (46) and a region of fluid (50) in the separation chamber, which is mostly hydrocarbon. The outer diameter of the upper pump mandrel is smaller than the inner diameter of the tubing string forming an inner gas annulus (52) therebetween. The inner gas annulus (52) is in fluid connection with the outer gas annulus (20) by means of a upper gas inlet port (54) in the tubing string (16) and vertically located above the upper packer (26). The lower pump mandrel (44) is connected to the lower end of the pump body (42) and the tubing string below the pump, thus, forming a lower pump mandrel chamber (56) which is in fluid connection with the injection chamber (not shown). The outer diameter of the lower pump mandrel (44) is smaller than the inner diameter of the tubing string (10), thus, forming an inner water annulus (58) therebetween. The inner water annulus (58) is in fluid connection with a region of fluid (60) within the separation annulus (32) that is mostly water by means of a water inlet port (62) in the tubing string (16) and which is vertically spaced above the lower packer (30). Fluid communication between the inner gas annulus (52) and the inner water annulus (58) is prevented by a sealing ring (64) vertically spaced between the power gas inlet (66) and the water inlet check valve (68) of the pump body. Preferably, the sealing ring (64) is located slightly below the power gas inlet (66) of the pump body so as to allow any water within the inner water annulus to cool the pump body. The pump body (42) generally includes, in addition to the power gas inlet (66) and the water inlet check valve (68) already mentioned, a gas valve switching means (70), a power cylinder and piston combination generally indicated by arrow (72), a pumping cylinder and piston combination generally indicated by arrow (74), and a water outlet check valve (76). The interaction and operation of these and other elements of the pump body are described in greater detail below and with reference to FIG. 3 and FIG. 4. Securing means (78) are provided on the ends of the upper and lower pump mandrel so as to position and secure the downhole pump within the tubing string (16).

Figure 3:
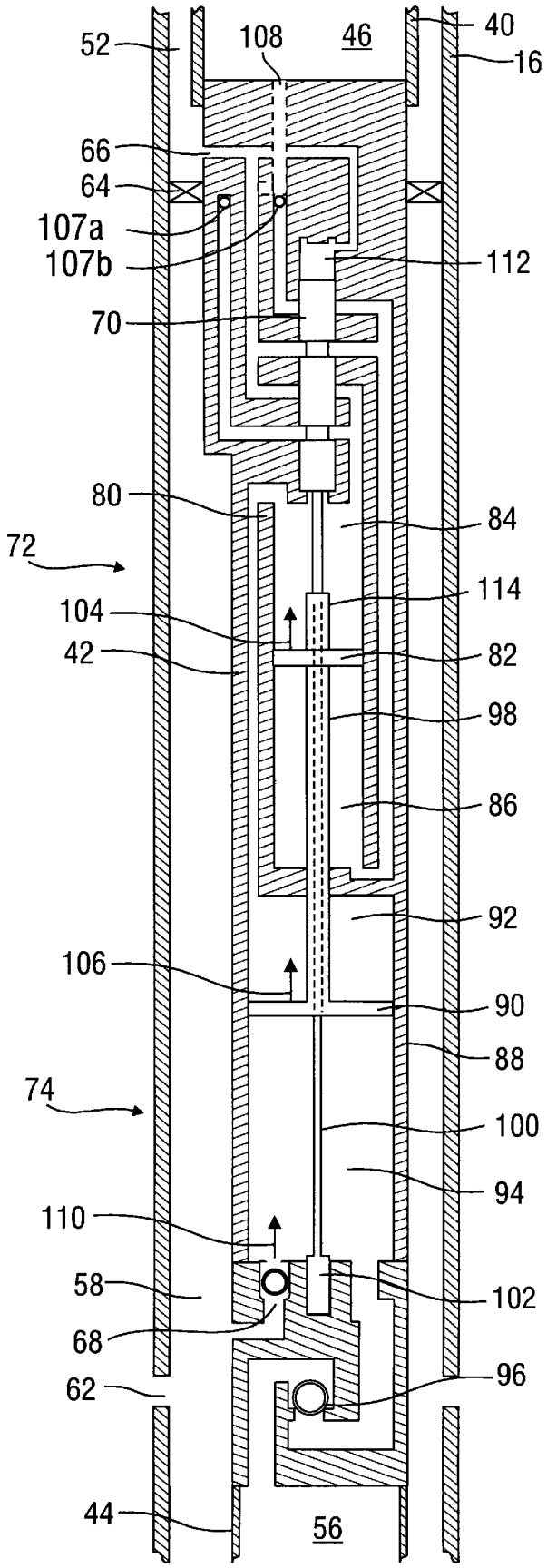
FIG. 3 is a cross-sectional view showing the flow of gas and fluids in a pump body on the "upstroke" of an illustrative embodiment of the present invention.

Turning now to FIG. 3, which shows, in cross section, the pump body (42) in the course of a upstroke. The pump body (42) is shown to have many interior passageways, the purpose of which should be appreciated by one skilled in the art given the present disclosure.

The pumping action of the pump is the result of the interaction of a power cylinder and piston combination, generally indicated by arrow (72), and a pumping cylinder and piston combination, generally indicated by arrow (74). The power cylinder (80) has within it, a reciprocating power piston (82) which forms upper (84) and lower (86) power cylinder chambers. Both the upper (84) and lower (86) power cylinder chambers are in fluid connection with the power gas inlet (66). The pumping cylinder (88) has within it a reciprocating pumping piston (90) which forms upper (92) and lower (94) pumping cylinder chambers. The upper pumping cylinder chamber (92) is in fluid connection with the upper power cylinder chamber (84), and the lower pumping cylinder chamber (94) is in fluid connection with the water inlet check valve (68) and the water outlet check valve (96).

A hollow connecting rod (98) transfers power generated by power cylinder and piston combination (72) to the pumping cylinder and piston combination (74). Within the hollow connecting rod (98) is a reciprocating gas valve switching rod (100), which, on one end, is connected to the gas valve switching means (70) and, on the other end, is connected to a valve switching shoulder (102) the role of which will be described below.

The gas valve switching means (70) reciprocates between an upstroke position and a downstroke position in concert with the reciprocating gas valve switching rod (100). The role of the gas valve switching means (70) is to direct the flow of high pressure gas and exhaust gas through the various passageways in the pump body.

When the gas valve switching means (70) is in the "upstroke" position as shown in FIG. 3, high pressure gas is directed from the inner gas annulus (52) through the power gas inlet (66) and into the lower power cylinder chamber (86). The power piston (82) and the pumping piston (90), being connected by the hollow connecting rod (98), move through their respective cylinders in a generally upward motion indicated by arrows (104) and (106) due to the action of the high pressure gas in the lower power cylinder chamber (86). With the gas valve switching means (70) in the upstroke position, any gas contained within the upper power cylinder chamber (84) or the upper pumping cylinder chamber (92) is directed via passageway **(107(*a*)) to the exhaust gas outlet (108) which releases the gas into the upper pump mandrel (46). The exhaust gas serves to assist in the gas lifting of the hydrocarbon component of the production fluid to the surface. For the purposes of clarity, the connections between passageways 107(*a*) and 107(*b*) and exhaust gas outlet (108) are shown in an elevated perspective view in FIG. 5. One skilled in the art should appreciate from this drawing that the exhaust passage way lies in a plane behind that of the cross-section shown in FIG. 3 and FIG. 4. One skilled in the art will further appreciate that there are many alternative ways to route the exhaust gas other than that specifically shown, such as dual exhaust passageways, and the like and that such alternatives are considered within the scope of the present invention As the pumping piston (90) is lifted through the pumping cylinder (88), water fills the lower pumping cylinder chamber (94) through the water inlet check valve (68), as generally indicated by arrow (110). The water outlet check valve (96) prevents any water that may be present in the lower pump mandrel chamber (56) from backwashing into the lower pumping cylinder chamber (94). Means for preventing the premature switching of the gas valve switching means (70), such as pressure chamber (112), should be provided to ensure that the full motion of the pumping action is realized. Upon completion of the upstroke, the gas valve switching means (70) is switched into the downstroke position (shown in FIG. 4) by suitable means, such as extension (114)**.

Figure 4:
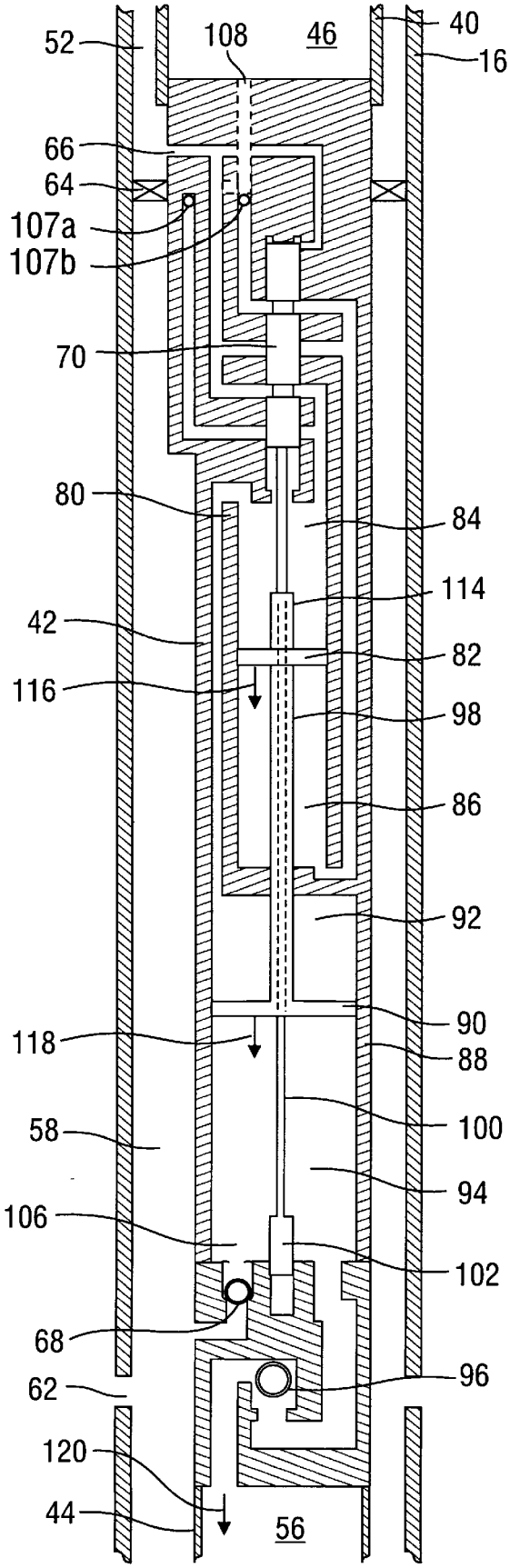
FIG. 4 is a cross-sectional view showing the flow of gas and fluids in a pump body on the "downstroke" of an illustrative embodiment of the present invention.
Figure 5:
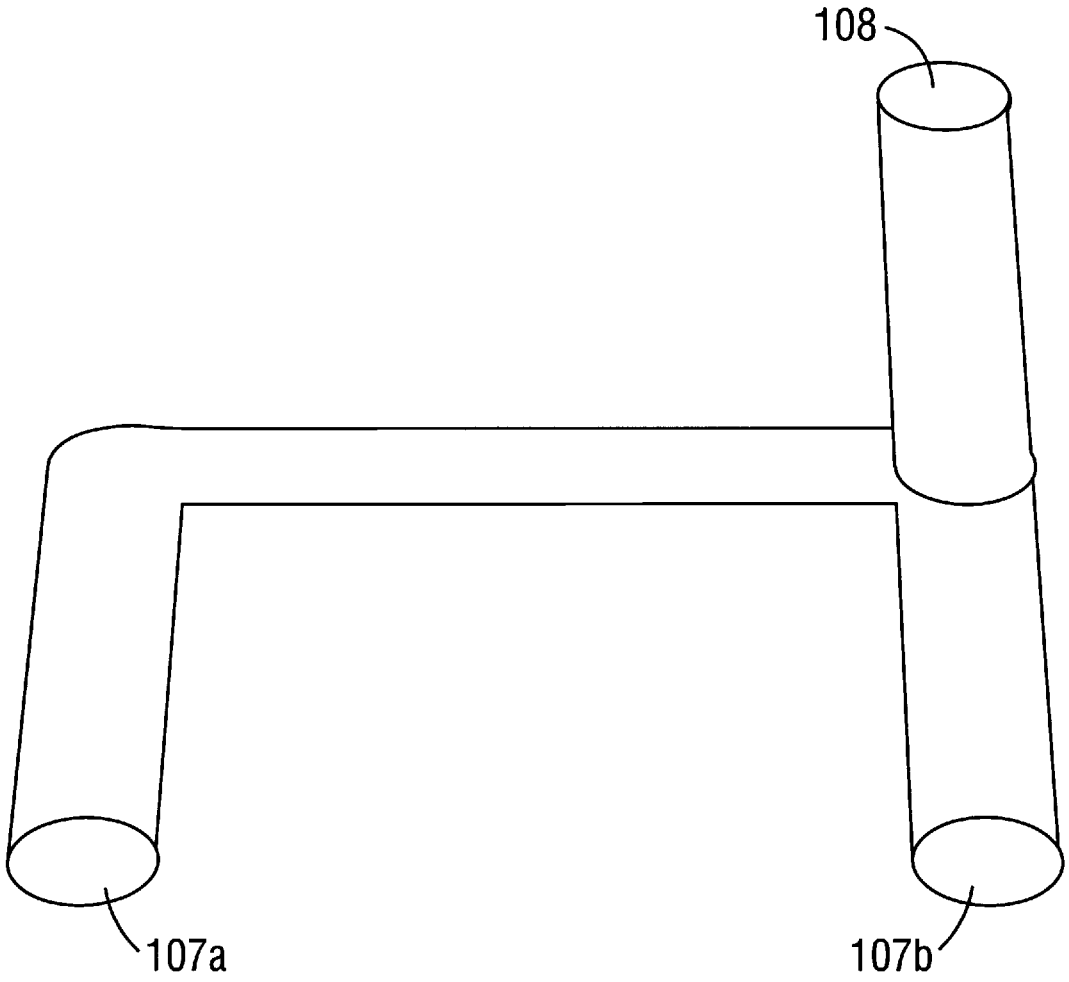
FIG. 5 is an elevated perspective view of the routing of exhaust passageways through the pump body in one embodiment of the present invention.

The downstroke configuration of the pump is shown in cross-section in FIG. 4 and to which the following description refers. The general motion of both the power piston (82), within the power cylinder (80), and the pumping piston (90), within the pumping cylinder (88), is indicated by arrows (116) and (118) respectively. The force required to generate the downstroke pumping motion is provided by high pressure gas which is directed to the upper power cylinder chamber (84) and the upper pumping cylinder chamber (92) by the gas valve switching means (70).

When the gas valve switching means (70) is in the downstroke position (as shown) the exhaust gas exiting the lower power cylinder chamber (86) is directed through passage way **107(*b*) to the exhaust gas outlet (108). As noted above the release of exhaust gas into the upper pump mandrel chamber (46) assists in the lifting of the hydrocarbon component of the production fluid to the surface During the course of the downstroke, the water within the lower pumping cylinder chamber (94) is forced through the water outlet check valve (96) and into the lower pump mandrel chamber (56) as indicated by arrow (120). As noted above, the lower pump mandrel chamber (56) is in fluid connection with the injection chamber and injection perforations (both not shown) through which the water is injected into a disposal formation. Closing of the water inlet check valve (68) prevents the backflow of water into the inner water annulus (58)**.

Upon completion of the downstroke, the pumping piston (90) comes into contact with the valve switching shoulder (102) which moves the gas valve switching means (70) into the upstroke position shown in FIG. 3.

As will be apparent to one skilled in the art, it is through the repetitive cycling between upstroke and downstroke that the pumping action of the downhole pump is realized. Further, it is the interaction of the pumping action of the downhole pump and the gravity separating ability of the downhole separation chamber that allows for the downhole disposal of the water component of the production fluid.

Alternative embodiments that achieve substantially the same result will be apparent to those skilled in the art. For example, a single cylinder pump, in which the natural pressure of the water is used in the upstroke and high pressure gas is used in the downstroke may replace the dual-cylinder pump described herein. In another alternative embodiment, the pistons described above are eliminated and the gas liquid interface may be to pump the water from the inner water annulus to the lower pump mandrel chamber.

While the structures and methods of the present invention have been described in terms of preferred embodiments, it will be apparent to those of skill in the art that variations may be applied to the what has been described herein without departing from the concept, spirit and scope of the invention. All such similar substitutes and modifications apparent to those skilled in the art are deemed to be within the spirit, scope and concept of the invention as it is set out in the following claims.

What is claimed is:

1. A method for the downhole disposal of a mostly water component of a production fluid in a gas lift hydrocarbon well, comprising:

separating downhole the mostly water component of the production fluid from a mostly hydrocarbon component of the production fluid by gravity; and operating a gas driven downhole pump, the pump being vertically positioned in the hydrocarbon well so as to preferentially uptake the mostly water component of the production fluid and inject the mostly water component of the production fluid into a disposal or injection formation.

2. The method recited in claim 1 further comprising utilizing the exhaust gas of the gas driven downhole pump to lift the mostly hydrocarbon component of the production fluid.

3. The method recited in claim 2 wherein the downhole separation of the water component of the production fluid from the mostly hydrocarbon component of the production fluid by gravity takes place downhole.

4. The method recited in claim 3 wherein the gas driven downhole pump comprises:

a pump body having upper and lower ends, a water inlet valve vertically positioned so as to be in fluid communication with the region of the separation annulus containing the mostly water component of the production fluid, a water outlet valve and gas operated means for pumping the mostly water component of the production fluid in through the water inlet valve and out through the water outlet valve;

an upper pump mandrel having upper and lower ends, the upper end being connected to a portion of the tubing string above the pump and the lower end being connected to the upper end of the pump body thus forming an upper pump mandrel chamber, the upper pump mandrel chamber being in fluid connection with the tubing string and a region within the separation annulus which contains the mostly hydrocarbon component of the production fluid; and a lower pump mandrel having upper and lower ends, the upper end being connected to the lower end of the pump body and the lower end being connected to a portion of the tubing string below the pump thus forming a lower pump mandrel chamber, the lower pump mandrel chamber being in fluid connection with the water outlet valve and in fluid connection with a underground formation into which the mostly water component of the production fluid is to be disposed.

5. The method of claim 4 wherein the gas operated means for pumping the mostly water component of the production fluid in through the water inlet valve and out through the water outlet valve comprises:

a power piston which reciprocates within a power cylinder;

a pumping piston which reciprocates within a pumping cylinder;

a hollow connecting rod connecting the power piston to the pumping piston so that the reciprocating motion of the two cylinders is in the same direction; and a means for directing at least a portion of the lift gas so as to generate a reciprocating pumping motion of the pumping piston within the pumping chamber.

6. An apparatus for the downhole disposal of a mostly water component of a production fluid in a gas lift hydrocarbon well, comprising:

a separation annulus for separating downhole the mostly water component of the production fluid from a mostly hydrocarbon component of the production fluid by gravity; and a gas driven downhole pump, the pump being vertically positioned in the hydrocarbon well so as to be in fluid connection with the mostly water component of the production fluid in the separation annulus.

7. The apparatus recited in claim 6 wherein the gas driven downhole pump further comprises an exhaust gas outlet through which an exhaust gas generated by the gas driven pump is released so as to at least partially assist in the gas lifting of the mostly hydrocarbon component of the production fluid.

8. The apparatus recited in claim 7 wherein the gas driven downhole pump further comprises:

a pump body having upper and lower ends, a water inlet valve vertically positioned so as to be in fluid communication with the region of the separation annulus containing the mostly water component of the production fluid, a water outlet valve, gas operated means for pumping the mostly water component of the production fluid in through the water inlet valve and out through the water outlet valve and wherein the exhaust gas outlet is located on the upper end of the pump body;

an upper pump mandrel having upper and lower ends, the upper end being connected to a portion of the tubing string above the pump and the lower end being connected to the upper end of the pump body thus forming an upper pump mandrel chamber, the upper pump mandrel chamber being in fluid connection with the tubing string and a region within the separation annulus which contains the mostly hydrocarbon component of the production fluid; and a lower pump mandrel having upper and lower ends, the upper end being connected to the lower end of the pump body and the lower end being connected to a portion of the tubing string below the pump thus forming a lower pump mandrel chamber, the lower pump mandrel chamber being in fluid connection with the water outlet valve and in fluid connection with a underground formation into which the mostly water component of the production fluid is to be disposed.

9. The apparatus of claim 8 wherein the gas operated means for pumping the mostly water component of the production fluid in through the water inlet valve and out through the water outlet valve comprises:

a power piston which reciprocates within a power cylinder;

a pumping piston which reciprocates within a pumping cylinder;

a hollow connecting rod connecting the power piston to the pumping piston so that the reciprocating motion of the two cylinders is in the same direction; and a means for directing at least a portion of the lift gas so as to generate a reciprocating pumping motion of the pumping piston within the pumping chamber.

10. An apparatus for the downhole disposal of the water component of a production fluid in an well, comprising:

a casing string extending downhole in the well and having therein vertically spaced upper production perforations and lower injection perforations;

a tubing string extending downhole within the casing string so as to form an outer annulus therebetween;

a upper packer and lower packer vertically spaced in the outer annulus, the upper packer vertically positioned above the upper production perforations and the lower packer vertically positioned between the upper production perforations and the lower injection perforations so as to form a separation annulus between the casing string and the tubing string in which the production fluid separates by gravity into regions comprising mostly of the hydrocarbon component and mostly of the water component of the production fluid;

a gas powered pump vertically positioned within the tubing string between the upper packer and the lower packer, the pump comprising a pump body having upper and lower ends, a water inlet valve vertically positioned so as to be in fluid communication with the region of the separation annulus containing the mostly water component of the production fluid, a water outlet valve and gas operated means for pumping the mostly water component of the production fluid in through the water inlet valve and out through the water outlet valve;

an upper pump mandrel having upper and lower ends, the upper end being connected to a portion of the tubing string above the pump and the lower end being connected to the upper end of the pump body thus forming an upper pump mandrel chamber, the upper pump mandrel chamber being in fluid connection with the tubing string and in fluid connection with a region within the separation annulus which contains the mostly hydrocarbon component of the production fluid by means of an hydrocarbon inlet port;

a lower pump mandrel having upper and lower ends, the upper end being connected to the lower end of the pump body and the lower end being in fluid connection with a portion of the tubing string below the pump thus forming a lower pump mandrel chamber, the lower pump mandrel chamber being in fluid connection with the water outlet valve and in fluid connection with a underground formation into which the mostly water component of the production fluid is to be disposed, and wherein, the upper pump mandrel forms an inner gas annulus within the tubing string; and the lower pump mandrel and the pump body form an inner water annulus within the tubing string, the inner gas annulus and the inner water annulus being separated by a sealing ring, and wherein the inner gas annulus is in fluid connection with a high pressure gas within the outer annulus above the upper packer by means of an upper gas inlet port.

11. The apparatus of claim 10 wherein the gas operated means for pumping the mostly water component of the production fluid in through the water inlet valve and out through the water outlet valve comprises:

a power piston which reciprocates within a power cylinder;

a pumping piston which reciprocates within a pumping cylinder;

a hollow connecting rod connecting the power piston to the pumping piston so that the reciprocating motion of the two cylinders is in the same direction; and a means for directing at least a portion of the lift gas so as to generate a reciprocating pumping motion of the pumping piston within the pumping chamber.

* * * * *